US010222158B2

(12) United States Patent
Milde, Jr.

(10) Patent No.: US 10,222,158 B2
(45) **Date of Patent: *Mar. 5, 2019**

(54) SECURE SMARTPHONE-OPERATED GUN LOCK WITH APPARATUS FOR PREVENTING FIRING IN PROTECTED DIRECTIONS

(71) Applicant: Karl F. Milde, Jr., Mahopac, NY (US)

(72) Inventor: Karl F. Milde, Jr., Mahopac, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/728,741

(22) Filed: Oct. 10, 2017

(65) Prior Publication Data

US 2018/0045479 A1 Feb. 15, 2018

Related U.S. Application Data

(60) Continuation-in-part of application No. 15/432,140, filed on Feb. 14, 2017, now Pat. No. 9,803,942, which (Continued)

(51) Int. Cl.
*F41A 17/46* (2006.01)
*F41A 17/06* (2006.01)
*F41A 17/08* (2006.01)

(52) U.S. Cl.
CPC ..... *F41A 17/066* (2013.01); *F41A 17/063* (2013.01); *F41A 17/08* (2013.01)

(58) Field of Classification Search
CPC ..... F41A 17/06; F41A 17/063; F41A 17/08; F41A 17/12; F41A 17/46
See application file for complete search history.

(56) References Cited

U.S. PATENT DOCUMENTS 7,263,206 B1 * 8/2007 Milbert ..... F41A 17/08 345/8
9,140,509 B2 9/2015 Sullivan et al.
(Continued)

FOREIGN PATENT DOCUMENTS

CA 2896364 A1 * 7/2014 ..... H04L 63/029

*Primary Examiner* — Stephen Johnson
(74) *Attorney, Agent, or Firm* — Karl F. Milde, Jr.

(57) ABSTRACT

Apparatus for locking and unlocking a gun to control its use includes a gun lock device that selects between two operative states: a locked state which prevents the gun from firing and an unlocked state which enables gun firing. An electronic imaging device which is mounted on the gun produces digital images of the area at which the gun is aimed. Electronic shooting protection apparatus, which is coupled to the gun lock device and to the electronic imaging device, produces a gun control signal that selects locked state when the gun is aimed a protected person or object. The shooting protection apparatus comprises:

(1) a first data memory, for storing digital images protected person and/or objects;
(2) a second data memory for storing digital images of persons or objects viewed in the area at which the gun is aimed; and
(3) a digital logic device, coupled to the first and second data memories, for comparing the digital images stored in the first data memory with digital images stored in the second data memory and for producing a gun control signal to set the gun lock device in the locked state when a digital image of a viewed person or object is substantially the same as a protected person or object.

25 Claims, 6 Drawing Sheets

Related U.S. Application Data is a continuation-in-part of application No. 15/063,665, filed on Mar. 8, 2016, now Pat. No. 9,644,912, which is a division of application No. 14/513,344, filed on Oct. 14, 2014, now Pat. No. 9,316,454, which is a continuation of application No. 14/140,658, filed on Dec. 26, 2013, now Pat. No. 8,931,195.

(60) Provisional application No. 62/562,652, filed on Sep. 25, 2017, provisional application No. 61/841,559, filed on Jul. 1, 2013.

(56) References Cited

U.S. PATENT DOCUMENTS

| | | | | |
|---|---|---|---|---|
| 9,217,626 | B1 | 12/2015 | Hajjar | |
| 9,310,165 | B2 | 4/2016 | Bell et al. | |
| 9,316,454 | B2 * | 4/2016 | Milde, Jr. ..... | F41A 17/063 |
| 9,803,942 | B2 * | 10/2017 | Milde, Jr. ..... | F41A 17/066 |
| 10,048,031 | B1 * | 8/2018 | Milde, Jr. ..... | F41A 17/066 |
| 2014/0028856 | A1 | 1/2014 | Ehrlich | |
| 2014/0152840 | A1 | 6/2014 | McCloskey et al. | |
| 2015/0184963 | A1 * | 7/2015 | Milde, Jr. ..... | F41A 17/066<br>42/70.06 |
| 2016/0054083 | A1 | 2/2016 | Kiyani et al. | |
| 2017/0074610 | A1 | 3/2017 | Winiecki | |
| 2017/0176123 | A1 | 6/2017 | Milde, Jr. | |

* cited by examiner

SECURE SMARTPHONE-OPERATED GUN LOCK WITH APPARATUS FOR PREVENTING FIRING IN PROTECTED DIRECTIONS

CROSS-REFERENCE TO RELATED APPLICATIONS

This application is a continuation-in-part of the U.S. patent application Ser. No. 15/432,140 filed Feb. 14, 2017 (now U.S. Pat. No. 9,803,942) which, in turn, is a continuation-in-part of U.S. patent application Ser. No. 15/063,665 filed Mar. 8, 2016 (now U.S. Pat. No. 9,644,912), which application is a division of U.S. patent application Ser. No. 14/513,344, filed Oct. 14, 2014 (now U.S. Pat. No. 9,316,454) and U.S. patent application Ser. No. 14/562,854, filed Dec. 8, 2014 (now U.S. Pat. No. 9,303,935). U.S. application Ser. No. 14/513,344, filed on Oct. 14, 2014, now U.S. Pat. No. 9,316,454 is a continuation in part of U.S. application Ser. No. 14/140,658, filed on Dec. 26, 2013, now U.S. Pat. No. 8,931,195. This application also claims priority from U.S. Provisional Application No. 62/562,652 filed Sep. 25, 2017.

This subject matter of this application is related to that of the following U.S. patent applications and patents:

(1) patent application Ser. No. 13/763,951, filed Feb. 11, 2013 (now U.S. Pat. No. 8,893,420);

(2) patent application Ser. No. 14/955,125, filed Dec. 1, 2015 (now pending);

(3) patent application Ser. No. 15/211,273, filed Jul. 15, 2016 (now pending);

(4) patent application Ser. No. 14/140,658, filed Dec. 26, 2013 (now U.S. Pat. No. 8,931,195)

(5) patent application Ser. No. 14/640,171, filed Mar. 6, 2015, (now U.S. Pat. No. 9,217,616);

(6) patent application Ser. No. 14/017,666 filed Sep. 4, 2013 (now U.S. Pat. No. 8,919,024);

(7) patent application Ser. No. 14/540,316, filed Nov. 13, 2014 (now pending); and (8) patent application Ser. No. 15/050,643, filed Feb. 23, 2016 (now U.S. Pat. No. 9,551,543).

To the fullest extent permitted by law, these applications and patents are incorporated herein by reference.

BACKGROUND OF THE INVENTION

The present invention relates to a gun lock for a firearm, such as a pistol or rifle, to prevent the owner or any other person who uses the gun from firing the weapon at a "friend," a VIP, or any other "protected person" or within sight of any object, such as a school bus, which is clearly "off limits" for the use of firearms.

It unfortunately sometimes happens that the owner of a gun or another person, who may or may not be authorized to use the gun (the "first person"), may act carelessly, for example on a hunting trip, at home or even at a firing range, and accidentally point the gun and quite unintentionally shoot a second person. This happened, for example, to the then Vice President of the United States, Richard "Dick" Cheney, while participating in a quail hunt on a ranch in Texas. Mr. Cheney accidentally shot a friend, Harry Wittington, a 78-year-old attorney who was along on the hunting trip, and severely wounded him with a shotgun.

It would be desirable if a gun could be automatically prevented from firing when and if it was inadvertently, or even intentionally, aimed at a second person who is not an "enemy" (a military term) of the first person.

In addition, it would be desirable if a gun (any gun) were prevented from firing (1) within certain geographical areas such as the vicinity of a school, place of worship or other location where people congregate, (2) aimed at a particular person who, as a government official or other VIP, may be under a heightened danger gun violence, or (3) aimed at a person who has obtained a protective order against someone else who has threatened gun violence.

Various systems are known which are designed to prevent "friendly fire" of a weapon. The U.S. Patent Publication No. 2017/0074610 to Winiecki discloses a so-called "safety beacon" which transmits a warning to the user of a firearm that a "friendly person is in their line of fire." The safety beacon is worn by a user in order to communicate their presence to the firearm and to consequently communicate their presence to the shooter of the firearm.

The U.S. Patent Publication No. 2014/0152840 to McCloskey et al. teaches a system for preventing firing of a gun when it is aimed at a friendly person (e.g. a soldier) or object (e.g. a military tank). This is accomplished by emitting an infra-red (IR) beam toward the target and detecting IR fluorescence, if present. In advance of using the system, all friendly targets must be provided with fluorescent material that emits IR at a certain frequency when illuminated.

The U.S. Pat. Nos. 9,140,509 and 9,217,626 and U.S. Patent Pub. No. 2017/0176123 each disclose a gun with a video camera mounted thereon that produces digital video images of the area at which the gun is aimed. However, the video images are coupled with a means for preventing the gun from firing.

The U.S. Pat. No. 9,310,165 discloses a military projectile launching control system which compares the confirmed target coordinates (CTC) of a target with the GPS coordinates of a friendly soldier and prevents firing when they are the same.

The U.S. Patent Pub. No. 2014/0028856 discloses a military firearm aiming system, having an imaging device connected to an image processor and display, for "reducing the probability of missing a target." The system uses GPS for determining the user location with respect to the locations of friendly and unfriendly forces to avoid "friendly fire."

The U.S. Patent Pub. No. 2016/0054083 discloses firearm safety apparatus configured to be attached to a gun having a trigger guard which prevents access to the trigger when locked. The trigger guard can be unlocked by a password, a biometric fingerprint, a voice command, an RFID sensor or the like. The specification, paragraph [0065] also states that the system may be integrated with a camera with a "built-in camera algorithm . . . configured to detect faces and have night vision, so as to identify names of potential targets (connected online or with built in memory), and would enable features like identification of friendly targets, and could eliminate friendly fire like hitting a family member at night or in the dark. The vision identification feature may provide a user notification-identification that the line of sight includes a friendly target. The notification-identification could also be accompanied with a slight vibration."

However, the disclosure is primarily concerned with the mechanical aspects of the trigger guard and includes no teaching of how to implement such a camera and algorithm to inhibit friendly fire.

The subject matter of these prior patents and the patent publication is incorporated herein by reference.

SUMMARY OF THE INVENTION

A principal objective of the present invention is to provide a gun lock for a gun that locks the weapon when it aimed at generally, or targets, protected persons or objects.

This objective, as well as other objectives which will become apparent from the discussion that follows, are achieved, in accordance with the present invention, by providing apparatus for locking and unlocking a gun to control its use, which comprises:

(a) a gun lock device that selects between two operative states: a locked state which prevents the gun from firing and an unlocked state which enables gun firing;

(b) an electronic imaging device which is mounted on the gun and produces digital images of the area at which the gun is aimed; and (c) electronic "shooting protection apparatus," which is coupled to the gun lock device and to the electronic imaging device, and which produces a gun control signal that selects a locked state when the gun is aimed at generally, or targets one or more protected persons or objects.

The shooting protection apparatus includes:

(1) a first data memory, for storing digital images protected persons and/or objects;

(2) a second data memory for storing digital images of persons or objects viewed in the area at which the gun is aimed; and (3) a digital logic device, coupled to the first and second data memories, for comparing the digital images stored in the first data memory with digital images stored in the second data memory and for producing a gun control signal that sets said gun lock device in the locked state when a digital image of a viewed person or object is substantially the same as a protected person or object.

In this context, the term "object" is intended to include not only a specific object, such as a particular dog, but also a type of object, such as dogs in general or yellow school buses, and plural objects, such as a crowd of people.

In a preferred embodiment of the present invention, the logic device includes a pattern recognition algorithm for comparing the digital image(s) stored in the first data memory with the digital images stored in the second data memory. The pattern recognition algorithm may include facial recognition, for example.

In one embodiment of the invention, the shooting protection apparatus is disposed the gun. In another embodiment, the shooting protection apparatus is disposed in a smartphone, separate and apart from the gun, but coupled to the gun via wireless Bluetooth or Wi-Fi.

In another preferred embodiment, the electronic imaging device includes means for adjusting the field of view of the electronic camera and the digital logic device includes means for controlling the field of view of the electronic camera. Advantageously the digital logic device includes means for selecting the field of view of the digital images of the area at which the gun is aimed.

According to one important aspect of the invention, the digital logic device is operative to cause the gun lock device to either enable the gun to be fired or to prevent the gun from being fired, respectfully, if and only if the images of protected persons and/or objects stored in the first data memory and the images obtained from the digital imaging device and stored in the second data memory are substantially similar.

The term "substantially similar" is intended to mean that the data are sufficiently similar to indicate a match. For example, image data obtained at different times about the same person are never exactly the same. Nevertheless, such data are sufficiently similar to make it possible to determine with fair certainty whether the data, obtained at different times, identifies the same person.

Advantageously, the electronic camera is provided with a zoom telephoto lens, that can provide a close-up view of the area at which the gun is aimed, and the gun is provided with a screen to display the camera image.

As described in the aforementioned U.S. patent Publication No. 2017/0176123 (which is the published version of U.S. patent application Ser. No. 15/432,140 from which priority is claimed), the apparatus for lock and unlocking a gun may be coupled with a smartphone to take advantage of the wide capabilities of this ubiquitous device. In this case the apparatus advantageously comprises:

(a) an electronic camera, configured to be disposed on the gun, for creating at least one digital image of an area at which the gun is aimed;

(b) a first data transmitter, configured to be disposed on the gun and coupled to the camera, for transmitting said at least one digital image;

(c) a gun lock device, configured to be disposed on the gun, including a locking device responsive to at least one gun control signal to select between two operative states, a locked state which prevents the gun from firing and an unlocked state which enables gun firing;

(d) a first data receiver for receiving a gun control signal that specifies one of a locked and an unlocked state; and (e) a smartphone, comprising a second data receiver for receiving said at least one digital image from said first data transmitter, a second data transmitter for transmitting a gun control signal to the first data receiver, and a logic device, coupled said second data receiver and said second data transmitter, for generating a gun control signal that specifies a locked state when said at least one digital image includes a person who, or an object that, is protected against being shot by the gun.

The logic device preferably includes a pattern recognition algorithm for recognizing the protected person or protected object from said at least one digital image and for producing said gun control signal when such protected person or protected object is recognized.

In preferred embodiments of this aspect of the invention the pattern recognition may include facial or object recognition.

Preferably the smartphone also comprises a data memory for storing image information identifying said protected person or protected object. In this case the logic device is coupled to this data memory and is operative to compare said at least one digital image with said image information.

Preferably also, the smartphone includes and a third data transmitter for transmitting said at least one digital image to a third data receiver at a remote location and/or the smartphone includes a third data receiver for receiving image information identifying said protected person or protected object from a remote location and logic device is operative to store the image information in this data memory.

According to a particular advantageous embodiment of the invention, the apparatus includes a direction finder, configured to be disposed on the gun and coupled to the first data transmitter, for determining an azimuthal direction in which the gun is aimed. The azimuthal direction is transmitted by the first data transmitter to the second data receiver in said smartphone, and the logic device within the smartphone is operative to determine an azimuthal direction from a position of the gun to a position of a protected person or protected object.

Advantageously the smartphone also includes a third data transmitter for transmitting the azimuthal direction from the position of the gun to the position of a protected person or protected object to a remote third data receiver.

Finally, the smartphone advantageously includes a GPS locator device coupled to the logic device for determining its GPS location coordinates, and a third data transmitter for transmitting said GPS location coordinates of said smartphone to a remote third data receiver.

According to still another preferred embodiment of the invention, the smartphone further includes a Find Friends app and the logic device is further operative to produce a gun control signal for transmission to the data receiver on the gun lock device, in order to set the gun lock device in the locked state and prevent the gun from firing when a smartphone responsive to the Find Friends app is located along an azimuth from the gun.

Further, in yet another preferred embodiment of the invention, the smartphone includes an input device, coupled to said logic device, for inputting personal information from a putative authorized person who wishes to control the gun, said personal information including biologic data identifying a bodily aspect of said putative authorized person; wherein said logic device includes an algorithm for generating a gun control signal from said personal information for transmission by said second data transmitter to said first data receiver that specifies either a locked state or an unlocked state in dependence upon whether the putative authorized person is a person who is actually authorized to control the gun.

The bodily aspect of the putative authorized person can be a facial image; an image of an iris; a retinal image; a fingerprint image; a palm print image; and/or an image of veins of a hand. The logic device is operative to process said image and to generate said gun control signal therefrom.

Advantageously, the input device includes a second electronic camera for producing a biologic identifying image of said bodily aspect of said putative authorized person, and a data memory for storing said biologic identifying image.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
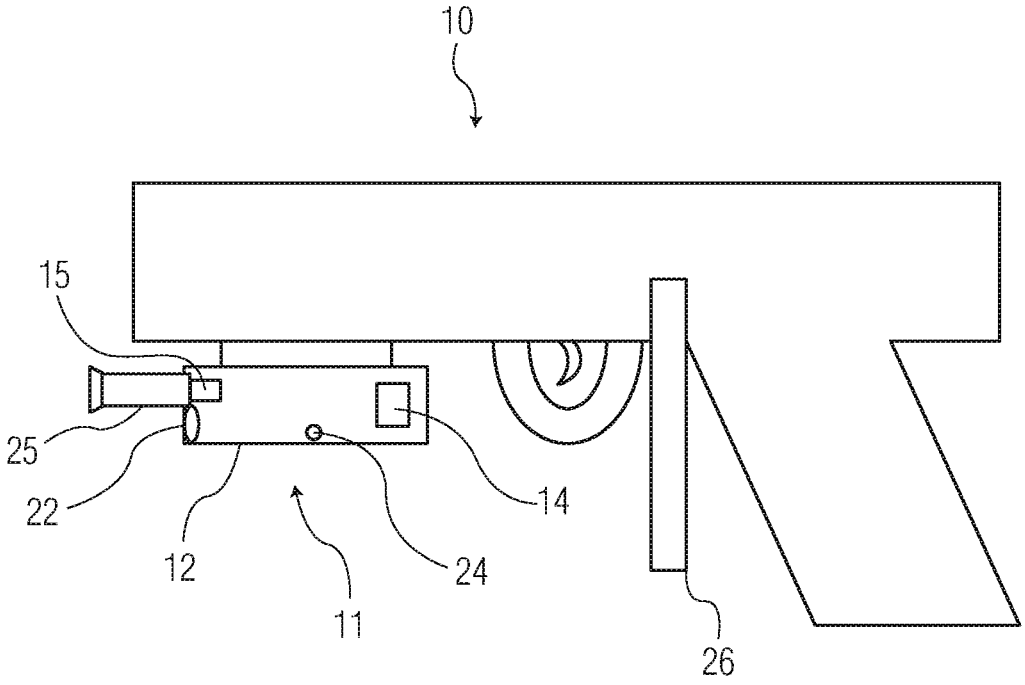
FIG. 1 is a representational diagram showing a gun that is equipped with a gun lock and video camera according to the present invention.

The preferred embodiments of the present invention will now be described with reference to FIGS. 1-8 of the drawings. Identical elements in the various figures are identified with the same reference numerals.

FIG. 1 shows a preferred embodiment of the present invention. A video camera 11 comprises a main body or housing 12 with an interior holding space housing a video unit, a video processing and logic unit, a data storage memory and a power supply unit. The gun camera 11 is attached to a gun 10. The gun 10 is preferably a common firearm pistol, a rifle or a "stun gun" (e.g. a Taser® gun).

The main body 12 can be joined to the gun 10 by any standard means for securing gun accessories to the gun 30, such as a clamping method, screw method, gun rail method and/or other like methods. The main body 12 can be joined to various types of long and short-barreled firearms, as well as an electric stun gun.

The video unit has a camera 15, preferably a CCD camera, for converting external images of the area at which the gun is aimed into electronic signals. A version of the gun camera (not shown) can also have a microphone configured into the arrangement so that sound can be also be recorded along with the video.

The video processing and logic unit is secured within the interior holding space of the main body 12. The video processing unit is a microprocessor which processes electronic signals produced by the video unit into digital video data. The date memory is electrically connected to the video processing and logic unit.

The power supply is preferably a rechargeable battery which is replaceable and detachable. The power supply unit provides the required electric power to the video unit, the video processing unit and to the data memory.

In addition, the gun camera may be formed with an auxiliary light or flash unit 22. The auxiliary light unit 22 produces an illuminating light source using the electric power provided by the power supply unit. This provides lighting to facilitate the video unit in the making of video images, including for night vision video recording. The gun 10 can automatically sequence itself to the amount of light needed for optimal recording.

Using a universal serial bus (USB) electric connector enables electrical connection to an external device conforming to USB specifications. Also, the battery of the power supply unit can be recharged in this way.

The gun camera 11 employs basic software that is capable of extracting and removing recorded images of Protected Persons and/or Protected Objects stored in a plug-in memory and comparing them with the video images of the area at which the gun is aimed.

The gun camera can also store the captured video images in the same or a second plug-in memory. This images data preferably automatically sorted by date. In the case of law enforcement, the data is encrypted and cannot be removed or tampered. This facilitates efficient and flawless investigation and resolution of police shooting issues. The data includes the number of times the gun was removed from the holster.

Using the aforementioned structure in conjunction with a pistol gun as an example, the gun camera 11 is inactivated when the gun 10 is holstered and not in use. In this position, the recording actuation sensors on the gun camera 11 and on the holster, are in direct communication.

However, removing the gun 10 from the holster breaks this communication and automatically activates video recording. The video recorder cannot be inactivated unless the gun is holstered. The video unit records video image, which usually includes sound, pointed at by the gun 10. When necessary, the auxiliary light unit 22 is activated for night vision, so immediate video recording is achieved both at night and during daylight hours.

A red green two-color LED indicator light 24 is preferably disposed on the main body 12. A continuous red light indicates that the gun camera is in the process of video recording; a flashing red light indicates that the recording unit is full. A continuous green light indicates that the rechargeable battery is fully charged. A flashing green light indicates that the gun camera is undergoing charging through an external power supply.

Preferably also, the gun camera 15 is provided with a telephoto lens 25, controlled either manually or automatically in dependence upon the requirements of the system in identifying known persons and/or objets. The image captured by the camera 15 is displayed on a video display 26 attached to the gun with the center of the screen at the aim point of the gun. The display is preferably disposed on one side of the gun but, alternatively or in addition, it could be disposed in the top or at the rear of the gun in the vicinity of, or in place of, a telescopic gun sight.

Figure 2:
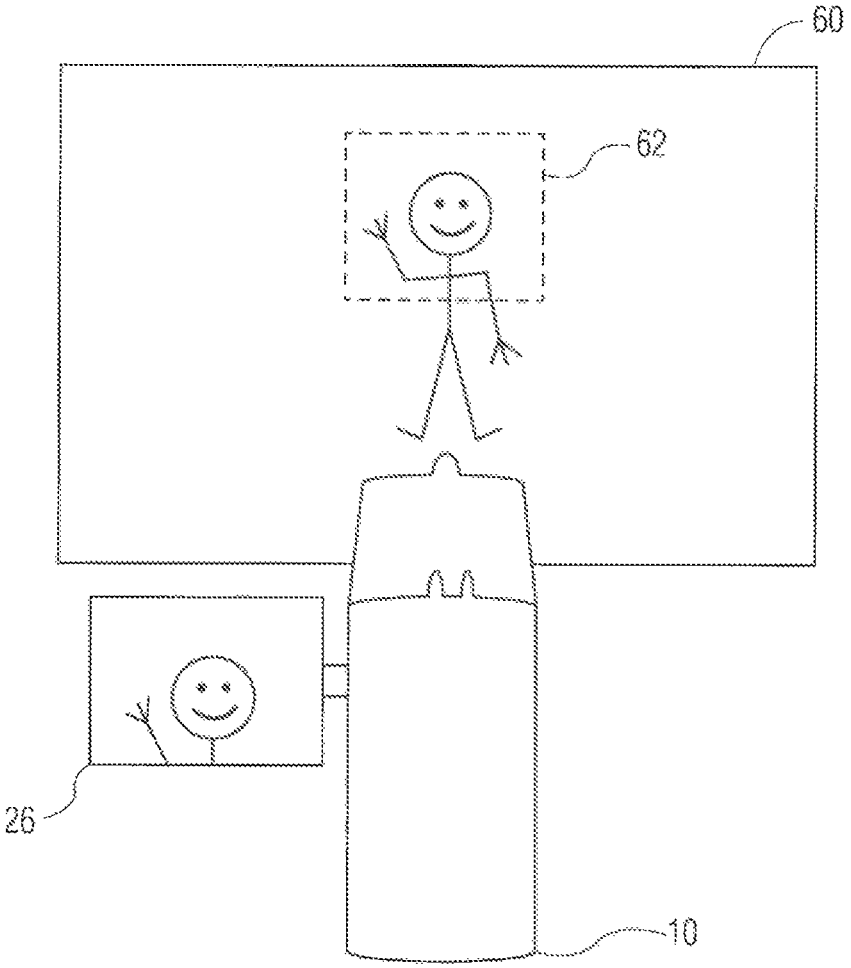
FIG. 2 is a rear view of the gun and video display of FIG. 1 showing the area viewed by the camera.

FIG. 2 shows a gun 10 in rear view which, using the telephoto lens 25 and CCD camera 15, captures an image 62 in the area of view 60 and displays this image on the display unit 26 with image enlarged, as shown, to assist the user in aiming.

Figure 3:
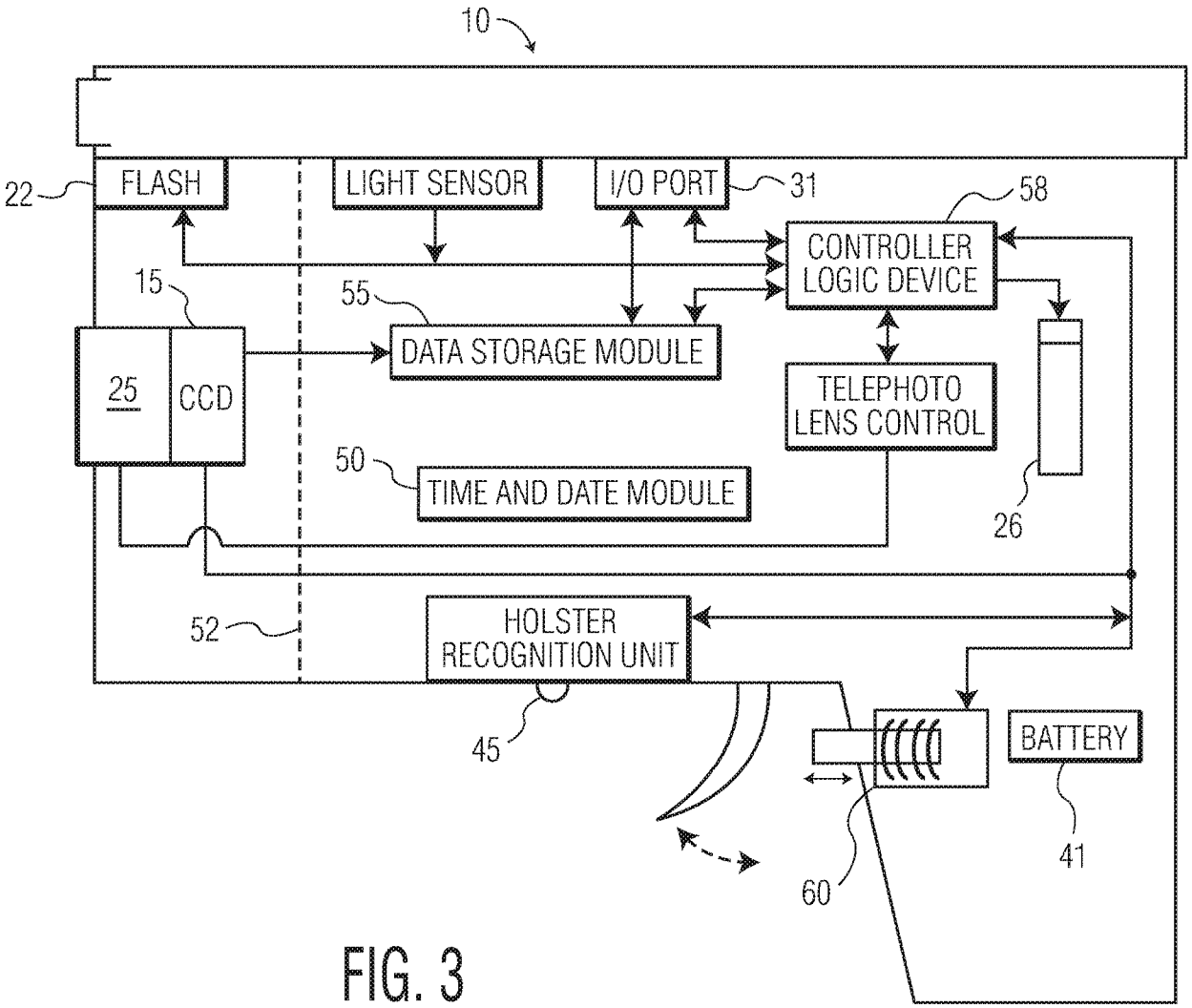
FIG. 3 is a block diagram showing a preferred embodiment of the electronic system employing the gun lock according to the present invention.

Turning to FIG. 3, when a video image is captured by the camera 15, it is sent to a video processor and data storage module 55. An image deletion module can optionally make room for the new images by deleting a portion of previously stored images (and/or reducing the quality of a portion thereof), except that certain high-priority previously stored images may be exempt from deletion and from quality reduction. Previously stored images that can be deleted or subjected to quality reduction may have been captured, for example, when a camera activation mechanism senses that the gun is no longer holstered, and/or when the safety is released, and thus the camera is able to capture images previous to the gun being fired. This camera activation mechanism 45 may, for example, include a simple hemisphere that is depressed when the gun is holstered, but is not depressed otherwise.

The data storage module 55 can be accessed via an input/output port 31, utilizing the necessary equipment and/or access codes. Likewise, the optional image deletion is automatic, and therefore the user does not need to delete specific images from the data storage module 55.

In addition to powering the camera, the battery 41 can also power a flash unit 22 that allows the camera to operate in dark environments. The forward-facing lens 25 is intended to take pictures of the target both before and after the gun is fired.

The camera can also be equipped with a laser sight that is also activated by releasing the safety, or activated by taking some other preliminary action necessary for firing the gun. The laser sight will preferably be powered by the same battery 41 that powers the camera, a time and date module 50, and the flash unit 22 (or alternatively separate batteries can be used for these purposes).

The line 52 indicates that the section to the right of that line may be a removable and replaceable cartridge, and in this particular embodiment the flash 22 is disposable, although a permanent flash can alternatively be used (in which case the flash would not be part of the cartridge).

Successive photo images obtained by the CCD camera 15 are stored in the data memory 55.

According to the present invention, a logic device 58 comprises a pattern recognition algorithm that compares the digital images of Protected Persons and/or Protected Objects previously stored in the data memory with the digital images obtained from the camera and produces a gun control signal to set a gun lock device 60 (in this case a solenoid activated pin) in a locked state when a digital image of a viewed person or object is substantially the same as a Protected Person or Protected Object, respectively. In this way, the gun is prevented from firing when it is aimed at the Protected Person or Object.

It will be understood that the data memories for receiving the photo or video images from the gun camera and for storing the images of protected persons or objects, as well as the logic device can be incorporated within a smartphone, in the manner fully disclosed in the U.S. Patent Pub No. 2017/0176123. In this case, immediately upon receipt of a signal that the user's gun has been removed from its holster, the logic device can automatically cause the smartphone to make a cellphone call to the user's partner and/or to the central station to request assistance and backup (for example, if the gun user is a peace officer). The smartphone can also automatically commence taking pictures or shooting a video, and can start recording sound from its own camera and microphone, respectively. If the phone is located on the shoulder of the peace officer, or if it is held in the officer's hand, it can also collect important evidence at this critical time.

When so activated and when recording the gun-related data transmitted from the gun in its memory, the smartphone can also record the exact time and location of each significant event, such as the removal of the gun from its holster or the firing of the gun, using its internal clock and GPS locator.

Figure 4:
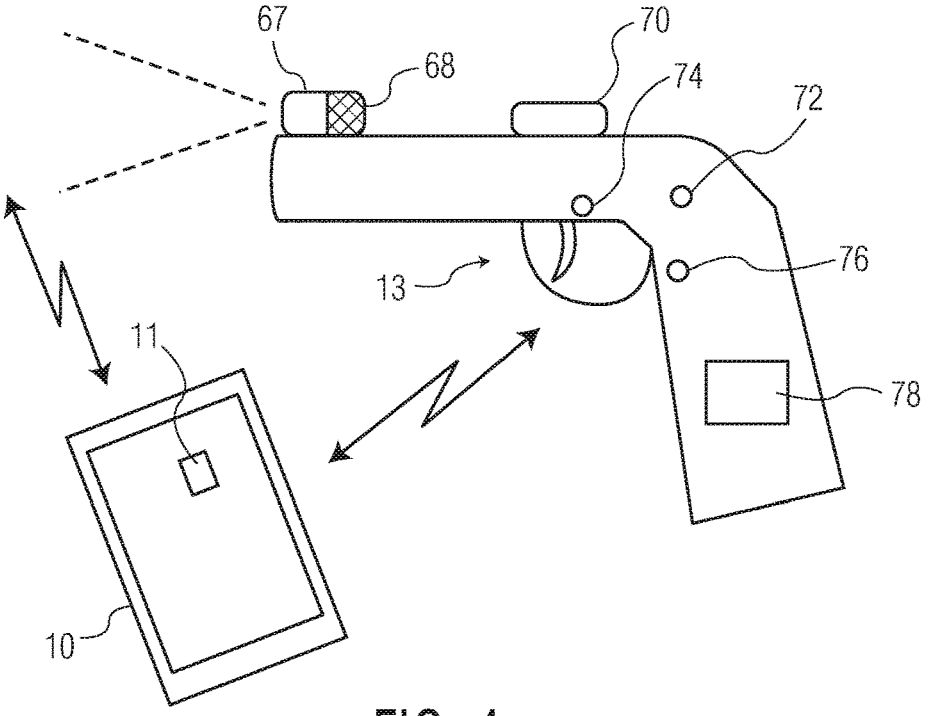
FIG. 4 is a representational diagram showing a smartphone and a gun that is equipped with a video camera and microphone.
Figure 5:
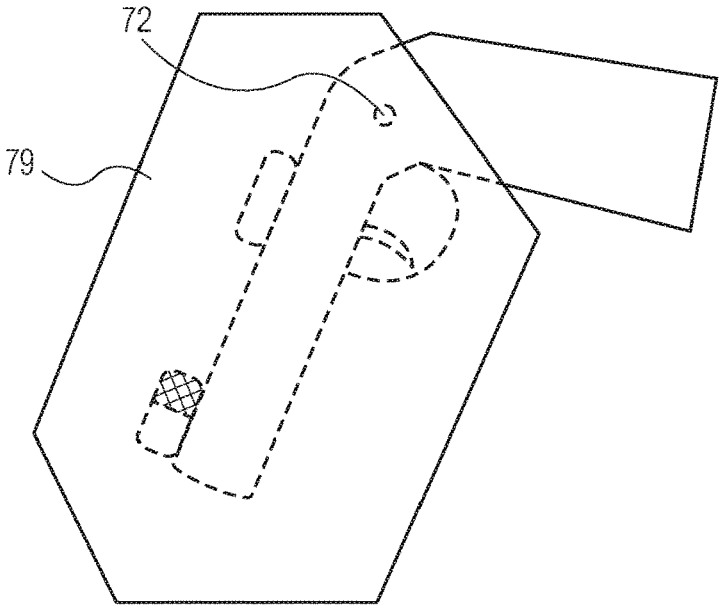
FIG. 5 is a close-up view of the gun of FIG. 4 arranged in a holster.
Figure 6:
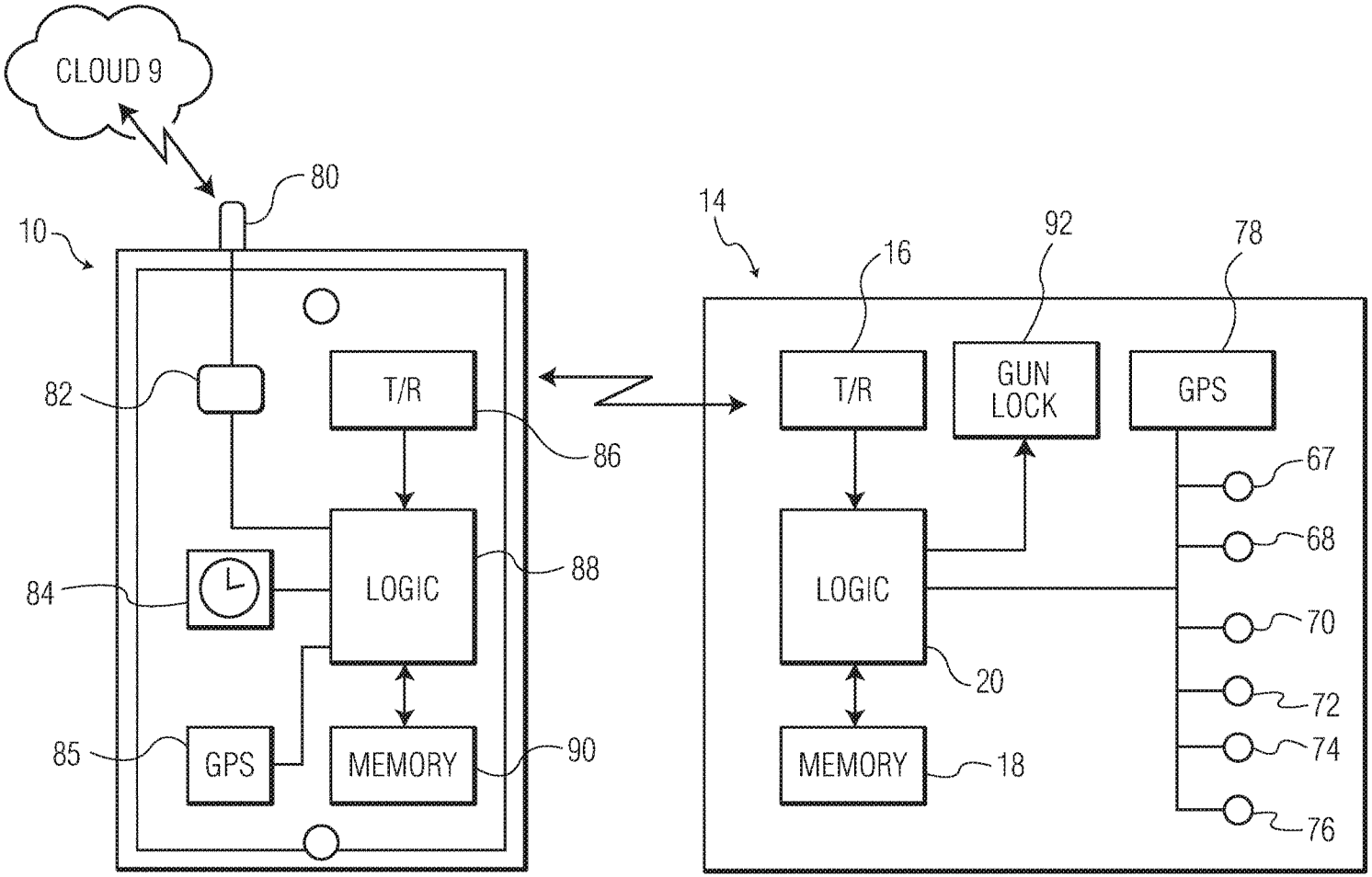
FIG. 6 is a block diagram showing the principal electronic components in the smartphone and gun of FIG. 4.

FIGS. 4, 5 and 6 are representational diagrams showing a gun with a camera as disclosed in the U.S. Pat. Nos. 9,140,509 and 9,217,616, the subject matter of which are incorporated herein by reference. With this embodiment of the invention the video image is transmitted to a smartphone which, in turn, relays the image to a central station, such as a police station or an office which receives "911" calls. According to the invention, the smartphone 10 sends and receives messages from a "cloud 9". Images of Protected Persons and Objects can be downloaded from the cloud to the smartphone for comparison with images received from the gun camera. Alternatively, images received from the gun camera can be transmitted to the cloud for pattern recognition by a computer system with advanced recognition technology (neural circuits or the like).

Figure 7:
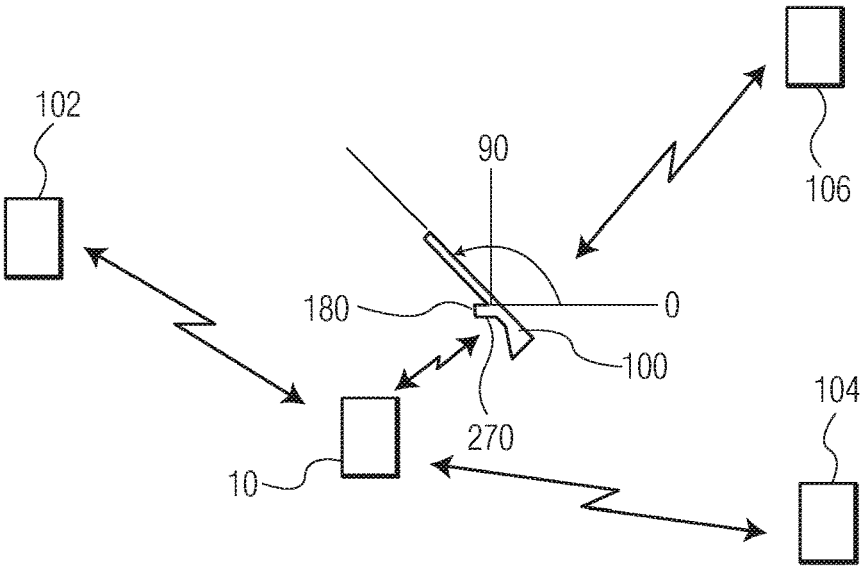
FIG. 7 is a representational diagram of a map, showing the location and azimuthal aim direction of a gun and the locations of the gun owner and three "friends" of this gun owner.

FIG. 7 is a representation of a map, showing the locations of a gun 100 (a rifle in this case) and the smartphones of four people: the smartphone 101 of the authorized gun user (e.g., the gun owner) and smartphones 102, 104, 106 of the gun user's friends. The gun 100 is aimed (pointed) in an azimuthal direction "X" which is sensed by its direction finder and transmitted to the gun user's smartphone along with the gun's location coordinates as determined by its GPS device.

Figure 8:
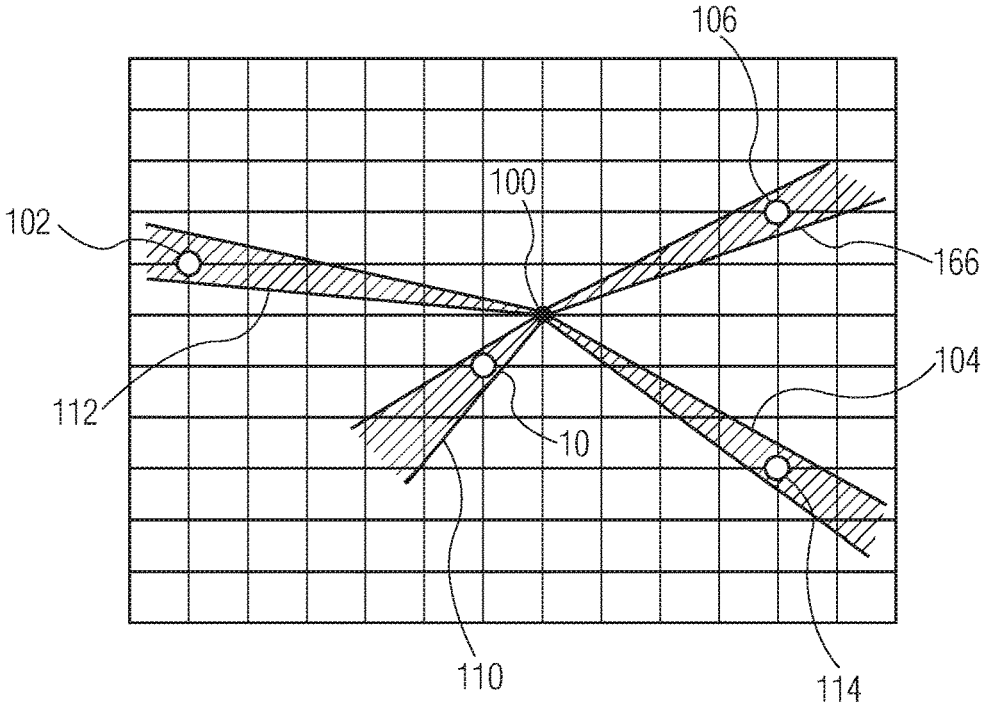
FIG. 8 is a representation of a "Find Friends" screen on the gun owner's smartphone illustrated in FIG. 4, showing the location of the gun and the locations of this gun owner and his three "friends."

The smartphone 101 includes the app "Find Friends" and, if the smartphones 102, 104 and 106 belong to people who have accepted the gun user's request to be "Friends," their locations will be known to the smartphone 101 and appear on its screen. Given its own location coordinates, as determined by its GPS locator device, and the location coordinates of the three Friends' smartphones 102, 104 and 106, as well as the location coordinates and the aiming azimuth X of the gun 100, the app on the smartphone 101 determines the angular direction from the gun 100 toward each of the three smartphones 102, 104 and 106, and activates the gun lock on the gun 100 to prevent the gun from firing when it is aimed at one of these smartphones (and thus one of the Protected Persons who carry these smartphones). The protected angles of aim, in which the gun lock is activated to prevent the gun from firing, are shown in FIG. 8 as hashed areas 112, 114 and 116, respectively.

Alternatively, or in addition, the video images obtained by the video camera on the gun, are transmitted to the smartphone 101 and stored in its memory. These images are compared to pre-stored images of Protected Persons and/or Protected Objects and analyzed by a pattern recognition algorithm in the smartphone to determine if the gun is aimed at such a person or an object such as a children's playground or a yellow school bus. If so, a gun lock signal is transmitted to the gun lock device to activate the gun lock and prevent the gun from firing.

Facial images of the Protected Persons and/or Protected Objects may be pre-stored in the smartphone for immediate use or may be downloaded via the Internet from another source (e.g., a "cloud"). Alternatively, the images obtained from the gun camera may be uploaded by the smartphone via the Internet to a server with software that performs the pattern recognition. If the server finds that a Protected Person and/or Protected Object is being targeted by the gun, it sends a signal to the smartphone, causing it to lock the gun to thereby prevent the gun from firing.

The smartphone app for carrying out the techniques described herein, for passively determining if and when the gun is aimed at a Protected Person and/or a Protected Object, and also the gun lock device for locking the gun when the gun is so aimed, are termed "shooting protection apparatus" in the claims hereinafter.

There has thus been shown and described a novel apparatus for locking and unlocking a gun which fulfills all the objects and advantages sought therefor. Many changes, variations and other uses and applications of the subject invention will become apparent to those skilled in the art after considering this specification and the accompanying drawings. All such changes, variations and other uses and applications which do not depart from the spirit and scope of the invention are deemed to be covered by the claims that follow.

What is claimed is:

1. Apparatus for locking and unlocking a gun, the apparatus comprising, in combination:

(a) a gun lock device configured to be disposed on the gun and including a locking device responsive to at least one gun control signal to select between two operative states, a locked state which prevents the gun from firing and an unlocked state which enables gun firing;

(b) an electronic imaging device configured to be disposed on the gun and including an electronic camera for producing digital images of an area at which the gun is aimed;

(c) electronic shooting protection apparatus coupled to the gun lock device and to the electronic imaging device for producing a gun control signal for selecting one of the locked state and the unlocked state, the shooting protection apparatus comprising:

(1) a first data memory, for storing at least one digital image of at least one protected person or object;

(2) a second data memory, coupled to the imaging device, for storing the digital images of viewed persons or objects in the area at which the gun is aimed;

(3) a digital logic device, coupled to the first data memory and the second data memory, for comparing the at least one digital image stored in the first data memory with the digital images stored in the second data memory and for producing a gun control signal to set the gun lock device in the locked state when a viewed person or object is substantially the same as a protected person or object;

whereby the gun is prevented from firing when the gun is aimed at a protected person or object.

2. The apparatus defined in claim 1, wherein the digital logic device includes a pattern recognition algorithm for comparing said at least one digital image stored in the first data memory with said digital images stored in the second data memory.

3. The apparatus defined in claim 2, wherein said pattern recognition algorithm includes a facial recognition algorithm.

4. The apparatus defined in claim 1, wherein the shooting protection apparatus is configured to be disposed the gun.

5. The apparatus defined in claim 1, wherein the shooting protection apparatus is disposed in a smartphone.

6. The apparatus defined in claim 1, wherein the electronic camera has a field of view in the area at which the gun is aimed.

7. The apparatus defined in claim 6, wherein the digital logic device includes a controlling algorithm for adjusting the field of view in the area at which the gun is aimed.

8. The apparatus defined in claim 1, wherein the digital logic device includes a controlling algorithm for selecting the field of view that appears in the digital images.

9. The apparatus defined in claim 6, further comprising a zoom lens disposed on the electronic camera, and a device for controlling the zoom lens for adjusting the field of view in the area at which the gun is aimed.

10. The apparatus defined in claim 1, further comprising a digital display screen coupled to said second memory for viewing the digital image produced by the camera.

11. Apparatus for locking and unlocking a gun, the apparatus comprising, in combination:

(a) an electronic camera, configured to be disposed on the gun, for creating at least one digital image of an area at which the gun is aimed;

(b) a first data transmitter, configured to be disposed on the gun and coupled to the camera, for transmitting said at least one digital image;

(c) a gun lock device, configured to be disposed on the gun, including a locking device responsive to at least one gun control signal to select between two operative states, a locked state which prevents the gun from firing and an unlocked state which enables gun firing;

(d) a first data receiver for receiving a gun control signal that specifies one of the locked state and the unlocked state; and (e) a smartphone, comprising a second data receiver for receiving said at least one digital image from said first data transmitter, a second data transmitter for transmitting a gun control signal to the first data receiver, and a logic device, coupled to said second data receiver and to said second data transmitter, for generating said gun control signal that specifies the locked state when said at least one digital image includes a person who, or an object that, is protected against being shot by the gun;

wherein said logic device includes a pattern recognition algorithm for recognizing the protected person or protected object from said at least one digital image and for producing said gun control signal when such protected person or protected object is recognized.

12. The apparatus defined in claim 11, wherein said pattern recognition includes facial recognition.

13. The apparatus defined in claim 11, wherein said pattern recognition includes object recognition.

14. The apparatus defined in claim 11, wherein said smartphone further comprises a data memory for storing image information identifying said protected person or protected object, and wherein said logic device is coupled to said data memory and is operative to compare said at least one digital image with said image information.

15. The apparatus defined in claim 11, wherein said smartphone includes and a third data transmitter for transmitting said at least one digital image to a third data receiver at a remote location.

16. The apparatus defined in claim 15, wherein said smartphone includes a third data receiver for receiving image information identifying said protected person or protected object from a remote location and wherein said logic device is operative to store said image information in a data memory.

17. The apparatus defined in claim 11, further comprising a direction finder, configured to be disposed on the gun and coupled to said first data transmitter, for determining an azimuthal direction in which the gun is aimed, wherein said azimuthal direction is transmitted by said first data transmitter to said second data receiver in said smartphone.

18. The apparatus defined in claim 17, wherein said logic device is operative to determine an azimuthal direction from a position of the gun to a position of a protected person or protected object.

19. The apparatus defined in claim 18, wherein said smartphone includes and a third data transmitter for transmitting said azimuthal direction from the position of the gun to the position of a protected person or protected object to a remote third data receiver.

20. The apparatus defined in claim 11, wherein said smartphone includes a GPS locator device coupled to said logic device for determining GPS location coordinates of said smartphone.

21. The apparatus defined in claim 20, wherein said smartphone includes and a third data transmitter for transmitting said GPS location coordinates of said smartphone to a remote third data receiver.

22. The apparatus defined in claim 17, wherein said smartphone further includes a Find Friends app and wherein said logic device is further operative to produce said gun control signal, for transmission to the data receiver on the gun lock device, to set the gun lock device in the locked state and prevent the gun from firing when a second smartphone responsive to the Find Friends app is located in said azimuthal direction.

23. The apparatus defined in claim 11, wherein said smartphone includes an input device, coupled to said logic device, for inputting personal information from a putative authorized person who wishes to control the gun, said personal information including biologic data identifying a bodily aspect of said putative authorized person; wherein said logic device includes an algorithm for generating said gun control signal from said personal information for transmission by said second data transmitter to said first data receiver that specifies either said locked state or said unlocked state in dependence upon whether the putative authorized person is a person who is actually authorized to control the gun.

24. The apparatus defined in claim 23, wherein said bodily aspect of said putative authorized person is selected from the group consisting of: a facial image; an image of an iris; a retinal image; a fingerprint image; a palm print image; and an image of veins of a hand; and wherein said logic device is operative to process an image of said bodily aspect and to generate said gun control signal therefrom.

25. The gun lock apparatus of claim 23, wherein said input device includes a second electronic camera for producing a biologic identifying image of said bodily aspect of said putative authorized person, and a data memory for storing said biologic identifying image.

* * * * *